US005271099A

United States Patent [19]

Lin

[11] Patent Number: 5,271,099

[45] Date of Patent: Dec. 21, 1993

[54] SUNSHADE CAP WITH A DOUBLE LAYER VISOR

[76] Inventor: Ming-Huei Lin, No. 697, Sec 1, Chung Shan Rd, Hu-Nei Hsiang, Kaohsiung, Taiwan

[21] Appl. No.: 970,466

[22] Filed: Nov. 2, 1992

[51] Int. Cl.[5] ..... A42B 1/24

[52] U.S. Cl. ..... 2/10; 2/209.13

[58] Field of Search ..... 2/10, 12, 171.1, 185 R, 2/196, 199, 209.1

[56] References Cited

U.S. PATENT DOCUMENTS

| | | | |
|---|---|---|---|
| 4,850,049 | 7/1989 | Landis | 2/10 |
| 4,920,576 | 5/1990 | Landis | 2/185 R |
| 4,945,573 | 8/1990 | Landis | 2/10 |
| 4,985,935 | 1/1991 | Hur | 2/199 |

*Primary Examiner*—Clifford D. Crowder
*Assistant Examiner*—Diana L. Biefeld

[57] ABSTRACT

A sunshade cap with a double layer visor having an upper layer visor combined on and with a lower visor formed with a cap body by means of projections around on an outer circumference of the upper layer visor inserting in pockets provided around an outer edge of the lower visor, a heat insulating layer possible to be sandwiched between the upper and the lower visor for better function of shading sunlight, a vertical curved wall provided behind the double layer visors for decoration and safety, and a horizontal flat surface placed on the vertical curved wall and provided with inserting holes for inserting an additional little adornment like a flag, a flower, a cross, etc.

5 Claims, 7 Drawing Sheets

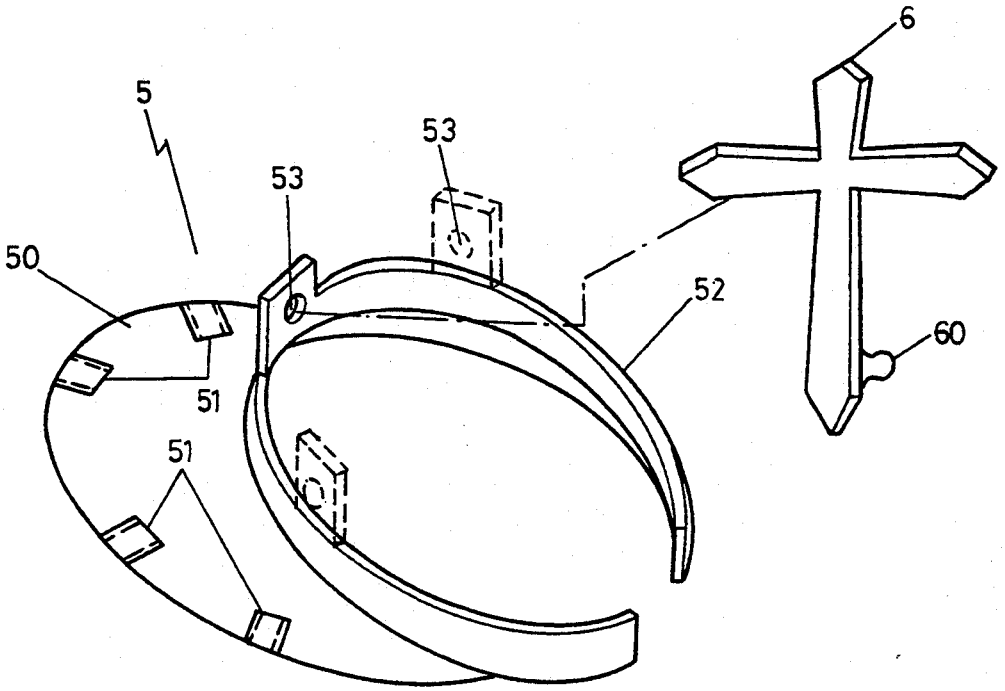
Fig 5
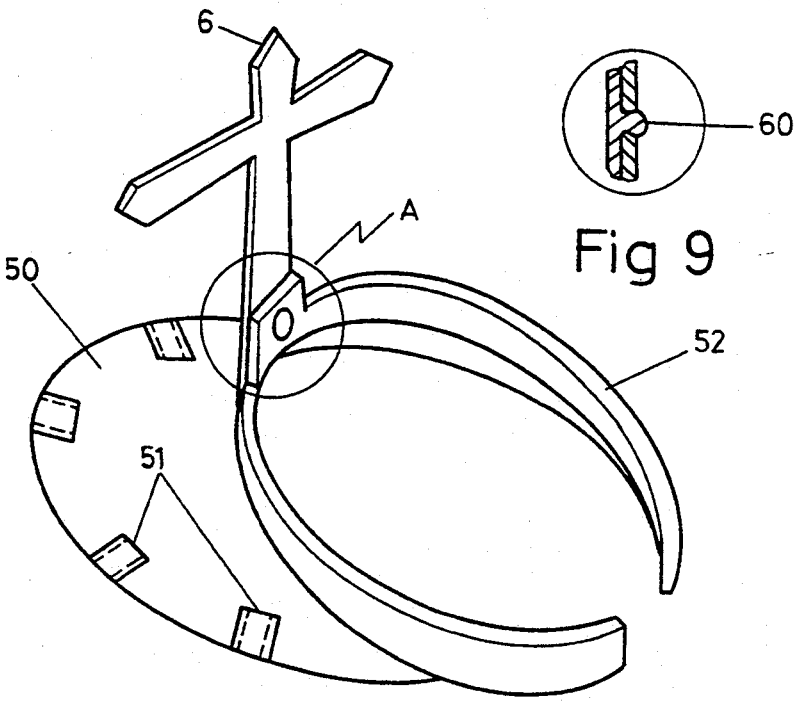
Fig 9
Fig 6

SUNSHADE CAP WITH A DOUBLE LAYER VISOR

BACKGROUND OF THE INVENTION

Nowadays, sunshade caps with a visor widely used generally have only one layer visor made of (A) a rather thick plastic plate or (B) a plastic plate covered with cloth. Sunshine has different degree of heat in various parts of the world, and in the region of low latitude these kinds of sunshade caps are still not good enough to shade strong sunlight as expected. Though a plastic visor is better for manufacture, but easily accumulates heat when it receives strong sunlight.

SUMMARY OF THE INVENTION

This invention has been devised to supply a sunshade cap with a double layer visor, which has a better function to shade strong sunshine and can also be extra added with an adornment such as a flower, a cross, a flag, etc.

One of features this invention intended to give is a double or more layer visor for shading sunlight.

Another feature is an upper layer visor not covered by anything and a lower visor formed with a cap body and covered with cloth having a popular design. The upper and the lower visor can be independently used and washed.

BRIEF DESCRIPTION OF DRAWINGS

FIG. 5 is an exploded perspective view of a third embodiment of a sunshade cap with a double layer visor in the present invention.

FIG. 6 is a perspective view of the third embodiment of a sunshade cap with a double layer visor in the present invention.

FIG. 9 is a cross-section view of part A of FIG. 6.

DETAILED DESCRIPTION OF THE INVENTION

Figure 1:
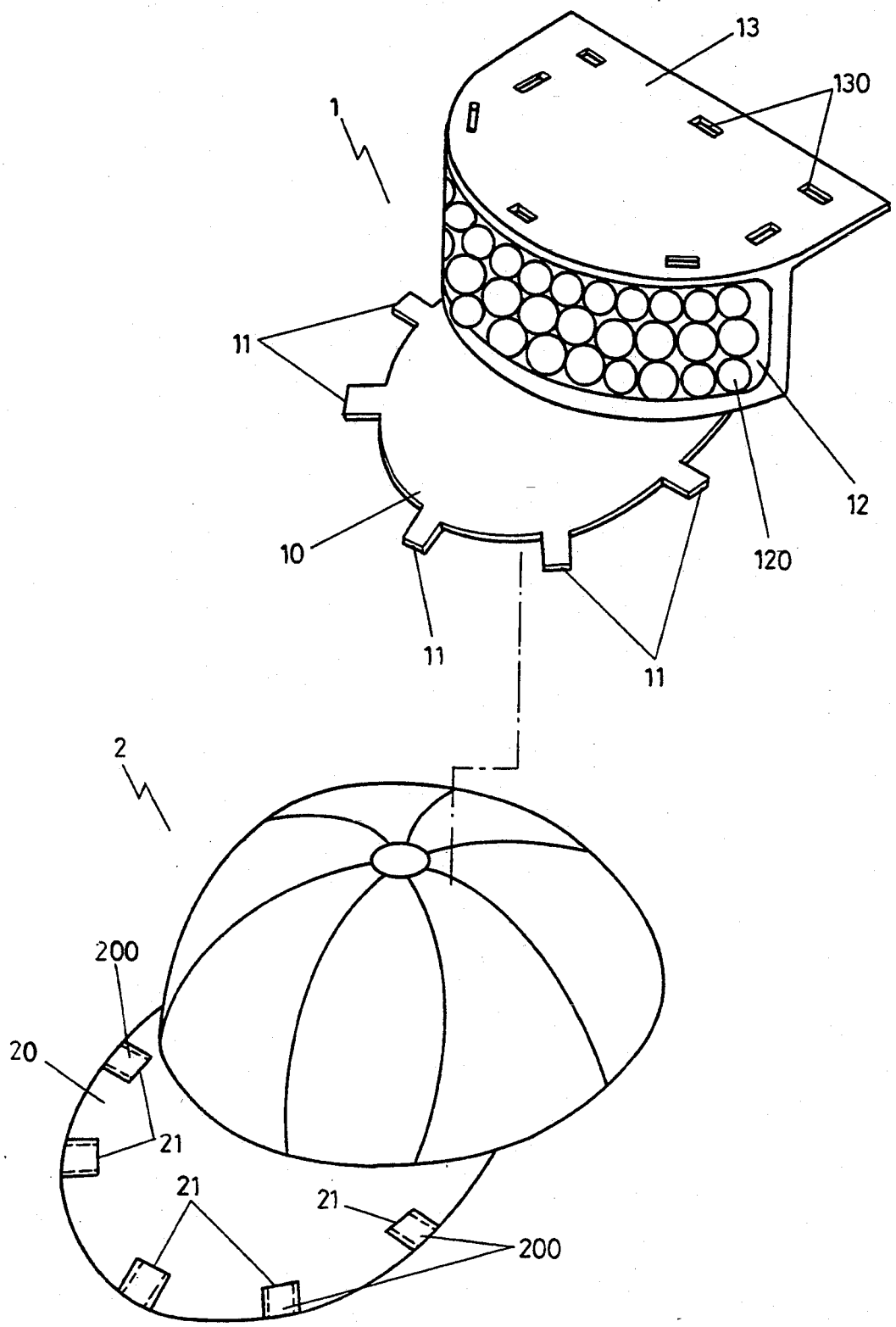
FIG. 1 is an exploded perspective view of a first embodiment of a sunshade cap with a double layer visor in the present invention.
Figure 2:
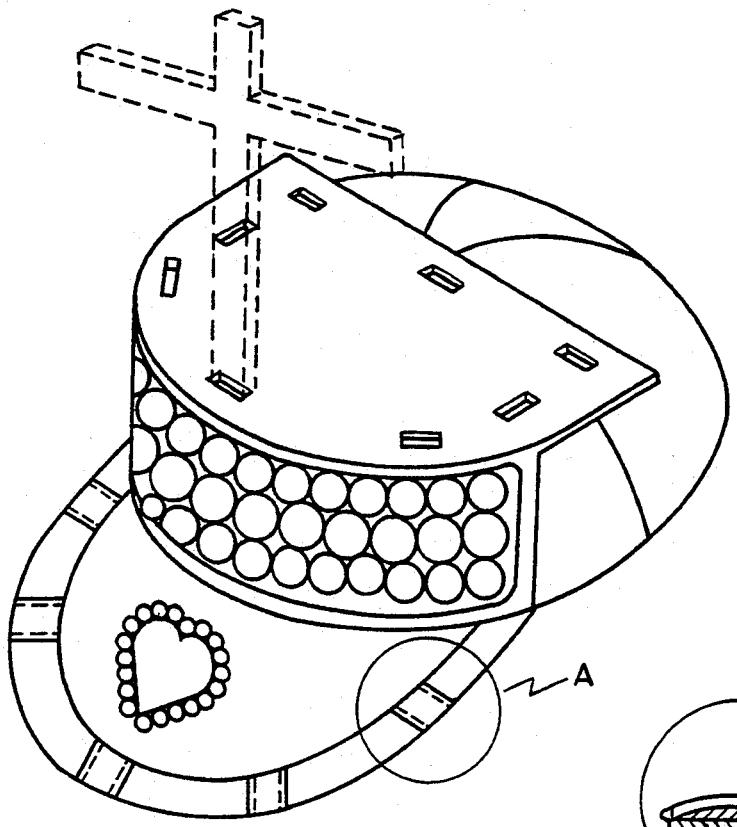
FIG. 2 is a perspective view of the first embodiment of a sunshade cap with a double layer visor in the present invention.
Figure 8:
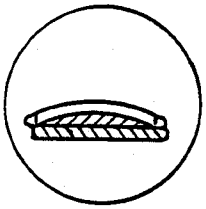
FIG. 8 is a cross-section view of part A of FIG. 2.
Figure 3:
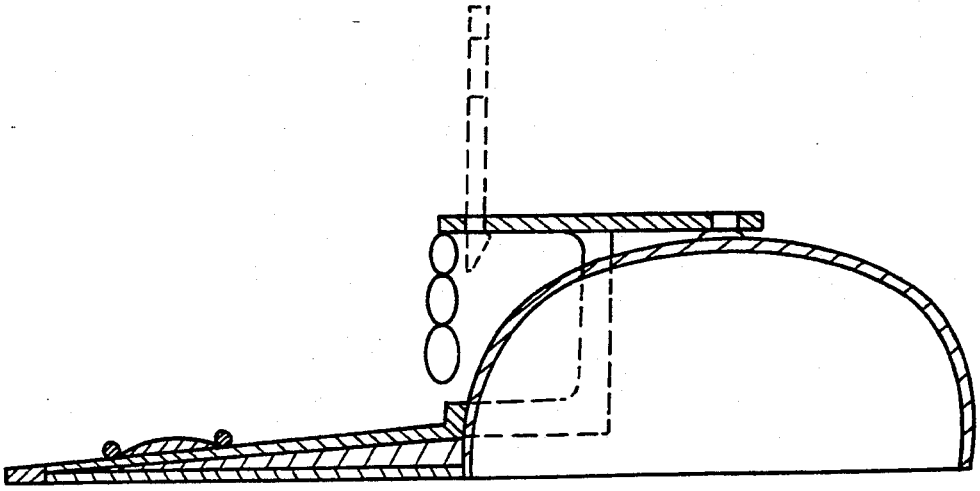
FIG. 3 is a cross-sectional view of the first embodiment of a sunshade cap with a double layer visor in the present invention.

A first embodiment of a sunshade cap with a double layer visor in the present invention, as shown in FIGS. 1–3, comprises an upper layer visor 1 having a visor body 10 of the same shape as a lower visor 20 formed with a cap body 2 and a plurality of projections around an outer edge of the visor body 10, a separate vertical curved hollow wall 12 behind the visor 20 and the upper visor 10, and a horizontal flat surface 13 extending from an upper edge of the curved hollow wall 12. The vertical curved hollow wall 12 can be fixed with a plurality of reflecting adorning pieces 120 and the horizontal flat surface 12 is bored with a plurality of inserting holes 130 spaced around near its circumference.

The cap body 2 has the lower visor 20, which has a plurality of pockets 21 of soft material sewn around the front circumference of the visor 20, and the number of the pockets 21 is the same as that of the projections 11 so that the projections 11 may fit in the pockets 21 to combine the upper layer visor 1 with the lower visor 20 together, forming a double layer visor.

A heat insulating layer 31 shown in FIG. 3 may be sandwiched between the upper layer visor 1 and the lower visor 20, preventing hot sunlight. In addition, the inserting holes 130 in the horizontal flat surface 13 can be used for inserting any additional adornments 4 for attraction, curiosity, etc.

Figure 4:
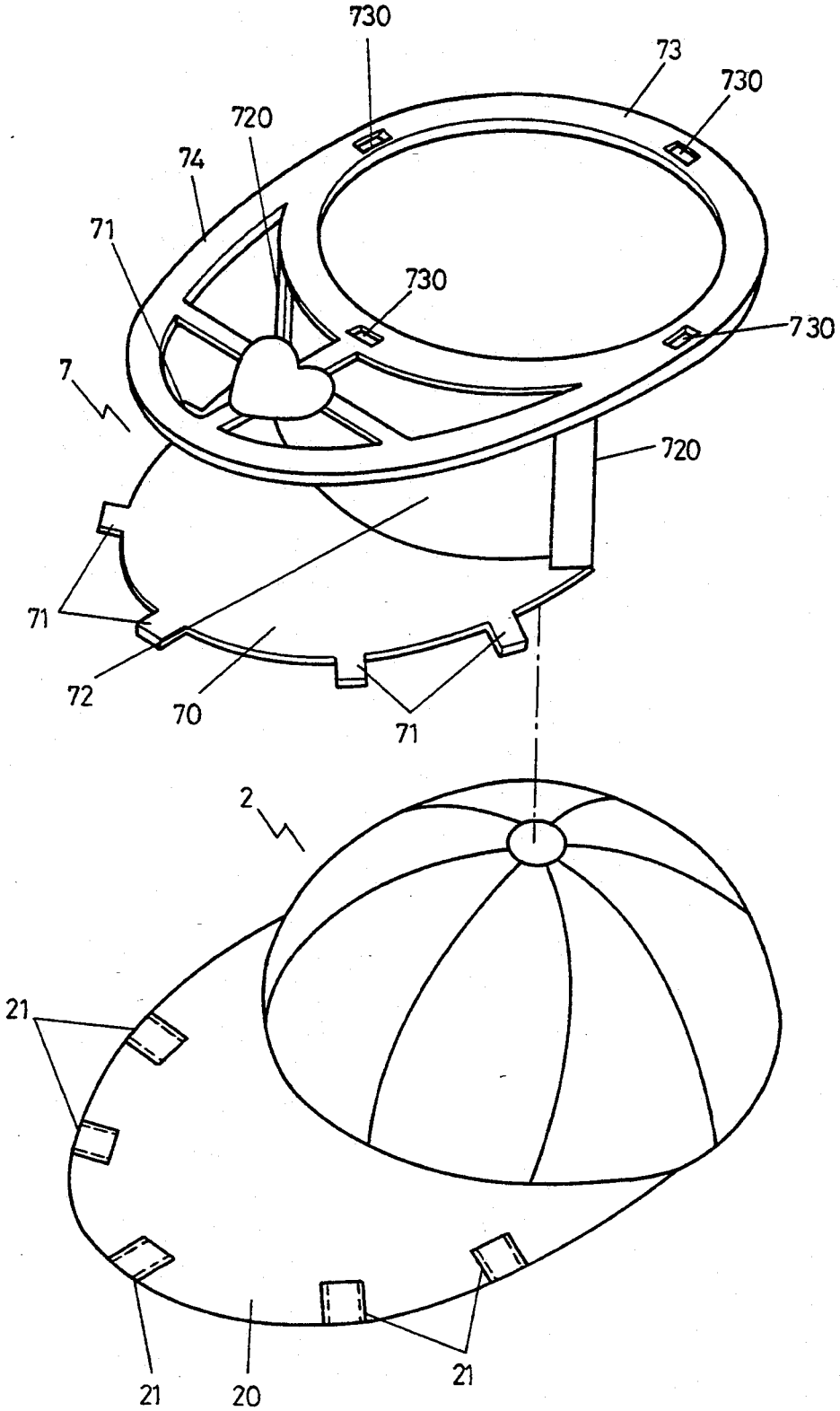
FIG. 4 is an exploded perspective view of a second embodiment of a sunshade cap with a double layer visor in the present invention.
Figure 7A:
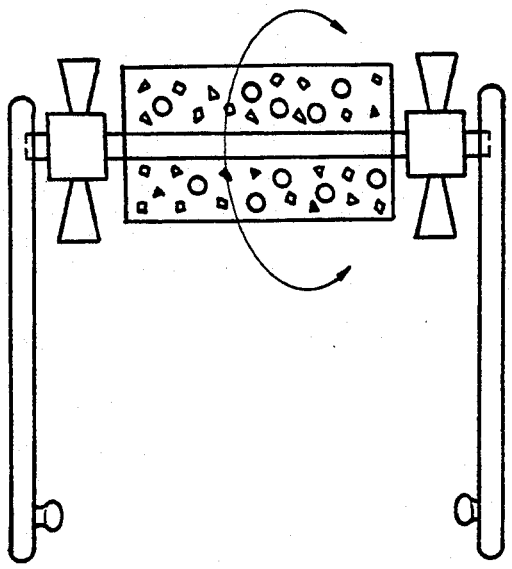
FIGS. 7A–7F are perspective views of additional adornments to be fixed on the sunshade caps in the present invention.
Figure 7B:
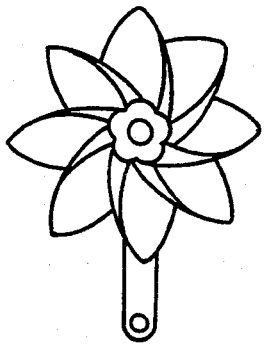
Figure 7C:
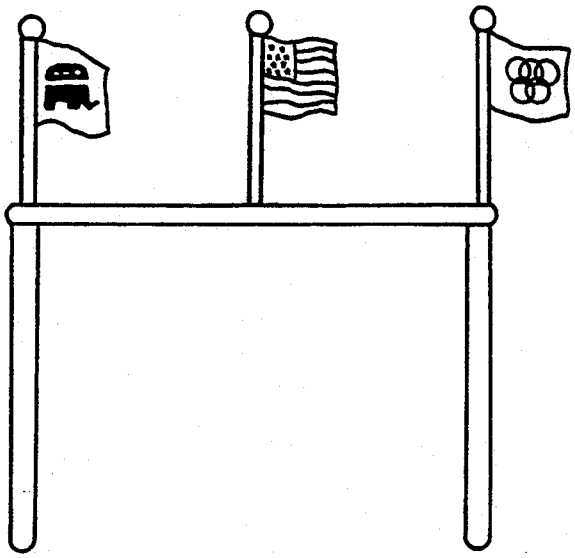
Figure 7D:
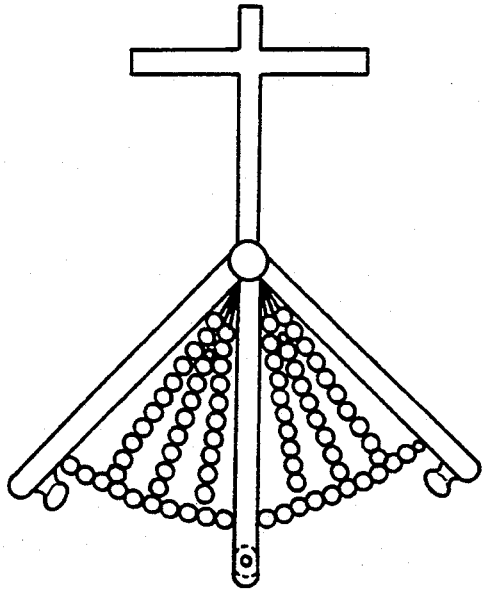
Figure 7E:
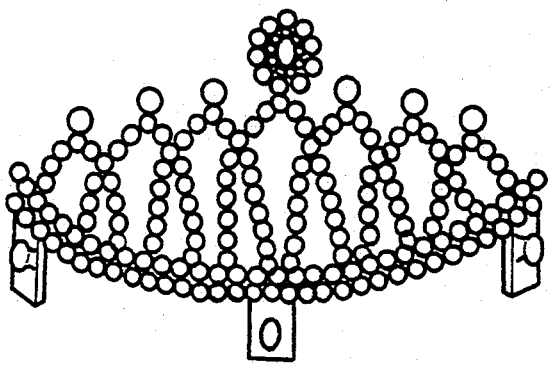
Figure 7F:
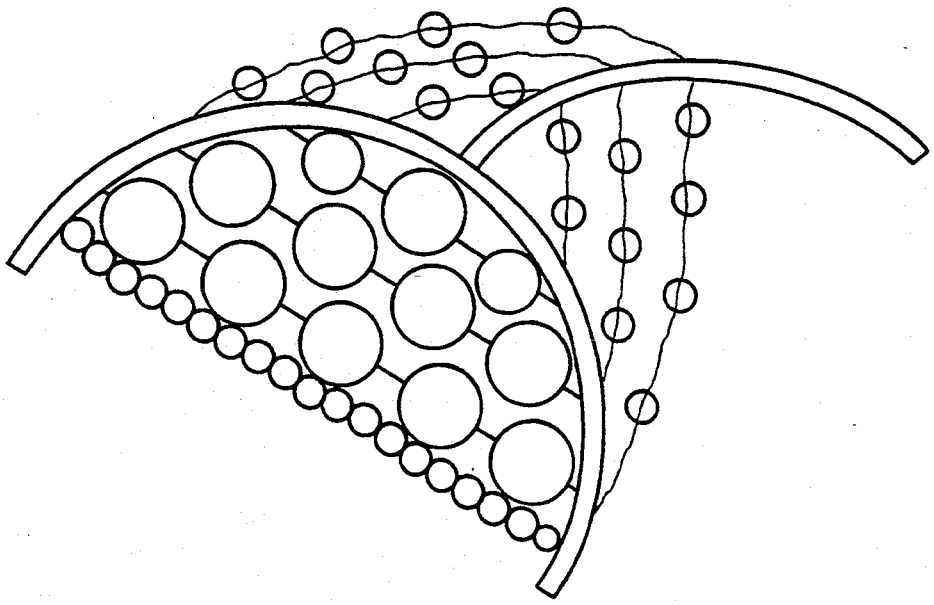

A second embodiment of the sunshade cap with a double layer visor is shown in FIG. 4, comprises an upper layer visor 7 having a visor body 70 also of the same shape as the lower visor 20 of a cap body 2, and a separate vertical curved hollow wall 72 sustained by two posts 720 at both sides. The visor body 70 also has a plurality of projections 71 to insert in the pockets 21 of the visor 20. In addition, a horizontal annular plate 73 is provided on the vertical curved hollow wall 72, having inserting holes 730 around its circumference and a curved flat extension 74 extending forward from the annular plate 73 to overlap the upper layer visor 7 for putting some adornment thereon.

A third embodiment of the sunshade cap with a double layer visor is shown in FIGS. 5 and 6. This sunshade cap 5 is hollow, only having an upper layer visor 50 and a circular wall 52 with a notch at a rear portion to fit around a head. The visor 50 has a plurality of pockets 51 around its front edge for the projections 11 of the upper layer visor 1 to combine the both together. Besides, the circular wall 52 can be provided with a projection with a hole 53 for a pin button 60 in an adornment to fit in as shown in FIG. 6. The adornment may be one of those shown in FIGS. 7A–7F.

What is claimed is:

1. A sunshade cap with a double layer visor comprising;

an upper layer visor having a plurality of projections around its front circumference, a vertical curved hollow wall behind the upper layer visor, and a horizontal flat surface on the vertical curved wall;

a lower visor formed with a cap body having a plurality of pockets around the circumference of the lower visor; and said projections of the upper layer visor inserting in the pockets in the lower visor to combine the upper visor with the lower layer visor.

2. The sunshade cap with a double layer visor as claimed in claim 1, wherein between said upper layer visor and the lower visor of the cap is sandwiched a heat insulating layer.

3. The sunshade cap with a double layer visor as claimed in claim 1, wherein said horizontal flat surface is of any shape and is provided with a plurality of inserting holes.

4. The sunshade cap with a double layer visor as claimed in claim 1, wherein if said cap is hollow, a circular wall of said cap is provided with any number of holes for fixing a pin button of an adornment therein.

5. The sunshade cap with a double layer visor as claimed in claim 1, wherein said upper layer visor is of any shape.

* * * * *